US006817696B2

(12) United States Patent
Miki et al.

(10) Patent No.: US 6,817,696 B2
(45) Date of Patent: Nov. 16, 2004

(54) INK JET PRINTER

(75) Inventors: Motoharu Miki, Hachioji (JP); Fumihiro Ueno, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 183 days.

(21) Appl. No.: 10/100,624

(22) Filed: Mar. 18, 2002

(65) Prior Publication Data

US 2002/0134305 A1 Sep. 26, 2002

(30) Foreign Application Priority Data

Mar. 21, 2001 (JP) ..... 2001-081123

(51) Int. Cl.[7] ..... B41J 2/165

(52) U.S. Cl. ..... 347/31

(58) Field of Search ..... 347/22, 24, 29, 347/30, 31, 34

(56) References Cited

U.S. PATENT DOCUMENTS 5,528,271 A * 6/1996 Ebisawa ..... 347/34
6,435,648 B1 * 8/2002 Murakami et al. ..... 347/29

FOREIGN PATENT DOCUMENTS

JP 03-240554 * 10/1991
JP 404169238 A * 6/1992 ..... 347/44
JP 05-293963 * 11/1993
JP 11-000998 A 1/1999

* cited by examiner

*Primary Examiner*—Shih-wen Hsieh
(74) *Attorney, Agent, or Firm*—Frishauf, Holtz, Goodman & Chick, P.C.

(57) ABSTRACT

An ink jet printer of the present invention includes at least one ink head which jets ink to a recording medium surface of a recording medium. This ink head has a nozzle plate in which a nozzle for jetting ink is formed and at least one rib which is formed so as to project toward the side of the recording medium rather than the nozzle. The ribs are gradually tapered toward the side of the recording medium.

26 Claims, 9 Drawing Sheets

INK JET PRINTER

CROSS-REFERENCE TO RELATED APPLICATIONS

This application is based upon and claims the benefit of priority from the prior Japanese Patent Application No. 2001-081123, filed Mar. 21, 2001, the entire contents of which are incorporated herein by reference.

BACKGROUND OF THE INVENTION

1. Field of the Invention

The present invention relates to an ink jet printer, and in particular, to an ink jet printer comprising an ink head which can prevent a recording medium from being contaminated by waste ink after a purging operation.

2. Description of the Related Art

Various kinds of image recording apparatuses are known. In recent years, ink jet printers adopting an inkjet recording system are widely used for the reason that they are relatively low-priced and small-sized. The ink jet printer has an ink head, a moving mechanism and a conveying mechanism. The ink head jets ink to a recording medium. The moving mechanism moves the ink head relative to the recording medium. The conveying mechanism moves the recording medium relative to the ink head.

The ink jet printer intermittently conveys the recording medium by the driving of the conveying mechanism. During the conveying operation, a separated distance between the recording medium and a surface of the ink head opposing to the recording medium, that is, a front surface of the ink head is about several millimeters.

The ink jet printer drives the ink head and jets ink, while the recording medium stops during the intermittent conveying operation. In this way, the ink jet printer forms a desired image on the recording medium.

The ink jet printer further has a platen. The platen holds the recording medium by a negative pressure. In this way, the recording medium is prevented from approaching to the side of the front surface of the ink head. That is, the platen operates so as to keep a constant space between the front surface of the ink head and the recording medium.

The ink head has an ink chamber and a nozzle. The ink chamber is a portion to store ink before ejection. The nozzle is an ejection aperture to jet the ink. In general, the ink head fails a print when bubbles enter the ink chamber or the nozzle is clogged with paper dust.

Accordingly, the ink jet printer periodically performs a maintenance process for preventing the print failure. For this reason, the ink jet printer has a maintenance mechanism for performing the maintenance process. In general, the maintenance mechanism has a cap, sucking means and a wiper blade. The cap is formed so as to be able to cover at least one nozzle. The sucking means is connected to the cap. The sucking means applies a negative pressure to the inside of the cap. The wiper blade is configured so as to be able to wipe out ink on a nozzle-forming surface (a front surface of the ink head).

This maintenance process is performed after the ink head is moved to a maintenance station. In this maintenance process, the maintenance mechanism performs a purging operation and a wiping operation. The purging operation is an operation to suck impurities (dust and bubbles) inside the nozzle and/or the ink Hi chamber together with the ink. The wiping operation is an operation to eliminate the ink remained on the nozzle-forming surface (the front surface of the ink head).

In the purging operation, first, the cap of the maintenance mechanism caps the nozzles of the ink head which is an object of the maintenance. Subsequently, the maintenance mechanism applies a negative pressure to the inside of the cap and sucks the ink inside the nozzle. After this purging operation, the large amount of ink (waste ink) remains on the nozzle-forming surface.

In the purging operation, the wiper blade wipes the large amount of waste ink remained on the nozzle-forming surface. In the specification, the ink remained on the front surface of the ink head is referred to as "waste ink".

By the maintenance process, each nozzle of the ink head keeps a state of being able to jet ink always normally.

However, even when the wiping operation is performed, it is difficult to completely wipe out the ink on the front surface of the ink head. The waste ink remained on the front surface of the ink head gradually flows downward. The waste ink collects in the lower side of the ink head front surface. The waste ink collected in this way swells from the front surface of the ink head. Accordingly, when the space between the recording medium and the front surface of the ink head is narrowed in this state, the waste ink is brought into contact with the recording medium. For example, the contact occurs when the recording medium is lifted from the platen at the time of the image forming.

Various ink heads are suggested to solve the problem. For example, the ink head disclosed in Jpn. Pat. Appln. KOKAI Publication No. 11-998 has the nozzle plate which curve to solve the problem. Concretely, the ink head has the front and rear surface. The nozzle plate is arranged in the front surface. As going downward, this nozzle plate curves toward the rear surface so that the space between the plate and the recording medium becomes larger. In other words, the ink head is formed so as to be in a tapered shape. With the ink head formed in this way, the waste ink which flows downward along the surface of the nozzle plate gradually separates from the recording medium. Therefore, this ink head reduces the possibility for the waste ink to remain on the recording medium. However, in the invention disclosed in this publication, the waste ink that descended toward the lowest end of the ink head gradually collects without place to go. For this reason, the collected waste ink finally drops by its own weight. When the waste ink drops, the waste ink contaminates the periphery of the ink head.

An ink head 1010 shown in FIG. 12A has ribs 1021 on its front surface. The ribs 1021 prevent the recording medium lifted from a platen from contacting a nozzle plate 1030 having a nozzle 1031. The ribs 1021 are formed in the periphery of the nozzle 1031 in front of the ink head 1010. The ribs 1021 project toward the side of the recording medium rather than the front surface of a nozzle plate 1030 (see FIG. 12B). Accordingly, the space between the distal end of the rib 1021 and the recording medium is smaller than the space between the front surface of the nozzle plate 1030 and the recording medium. Hence, the waste ink remained on the distal end of the rib 1021 is easily contacted by the recording medium.

Particularly, when an angular portion is formed along the longitudinal axis of the rib 1021 (see FIG. 12A), the waste ink 80 remains in a state of being swollen on the angular portion or slightly upward from the angular portion (see FIG. 12C). For this reason, there is strong possibility that, in the vicinity of the angular portion, the recording medium is brought into contact with the waste ink. When the rib 1021 is formed in the periphery of the nozzle in this way, the front surface of the ink head 1010 is not a uniform plane.

Therefore, it is difficult for the wiper blade to effectively wipe out the waste ink on a nozzle plate 1030 in the wiping operation. Accordingly, the large amount of waste ink remains on the front surface of the nozzle plate 1030 even after the wiping operation.

BRIEF SUMMARY OF THE INVENTION

The present invention is to solve the problems. An object of the present invention is to provide an ink jet printer that prevents contamination by waste ink or reduces contamination by waste ink to a lower degree.

In order to solve the problem and achieve the object, the ink jet printer according to the present invention is constituted as follows.

An ink jet printer according to a first aspect of the present invention comprises at least one ink head which jet ink to a recording medium surface of a recording medium. The ink head has a nozzle plate which has at least one nozzle for jetting ink, and at least one rib which projects toward the side of the recording medium rather than the nozzle. The rib is gradually tapered toward the side of the recording medium.

An ink jet printer according to a second aspect of the present invention comprises at least one ink head and at least one ink absorber. The ink head is opposed to a recording medium and jets ink to the recording medium. Further the ink head comprises a nozzle-forming surface and a curved surface. The nozzle-forming surface and the curved surface are opposed to the recording medium. The nozzle-forming surface has at least one nozzle for jetting ink. As going downward in a vertical direction, the curved surface curves so as to separate from the recording medium. The ink absorber is detachable from the curved surface.

An ink jet printer according to a third aspect of the present invention comprises at least one ink head, at least one slit, and an ink absorber. The ink head is opposed to a recording medium. The ink head jets ink to the recording medium. Further the ink head comprises a nozzle-forming surface and a curved surface. The nozzle-forming surface and the curved surface are opposed to the recording medium. The nozzle-forming surface has at least one nozzle for jetting ink. As going downward in a vertical direction, the curved surface curves so as to separate from the recording medium. The slit extends along the longitudinal axis of the ink head on the curved surface. Further, the slit reaches until a surface opposite to the surface of the ink head opposing to the recording medium. The ink absorber is provided in the region where the slit is formed in the surface opposite to the surface of the ink head opposing to the recording medium.

An ink jet printer according to a fourth aspect of the present invention comprises at least one ink head, and at least one ink absorber. The ink head is opposed to a recording medium and jets ink to the recording medium. Further the ink head comprises a nozzle-forming surface and a curved surface opposed to the recording medium. The nozzle-forming surface has at least one nozzle for jetting ink. As going downward in a vertical direction, the curved surface curves so as to separate from the recording medium. The ink absorber is fixed to at least a part of the curved surface.

An ink jet printer according to a fifth aspect of the present invention comprises at least one ink head, and at least one ink absorber. The ink head is opposed to a recording medium and jets ink to the recording medium. The ink head comprises a nozzle-forming surface and an angular portion. The nozzle-forming surface and the angular portion are opposed to the recording medium. The angular portion is formed by the nozzle-forming surface and a surface intersecting the nozzle-forming surface. The ink absorber is fixed to the ink head such that at least a part thereof contacts the angular portion.

An ink jet printer according to a sixth aspect of the present invention comprises at least one ink head and at least one ink absorber. The ink head is opposed to a recording medium and jets ink to the recording medium. The ink absorber is detachable from a surface of the ink head opposing to the recording medium. This ink absorber contacts the surface of the ink head opposing to the recording medium at the end of a purging operation of the ink head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION OF THE INVENTION

Hereinafter, embodiments of the present invention will be described with reference to the drawings.

First Embodiment

First, an ink jet printer 1 according to a first embodiment of the present invention will be described with reference to FIGS. 1A and 1B.

Figure 1A:
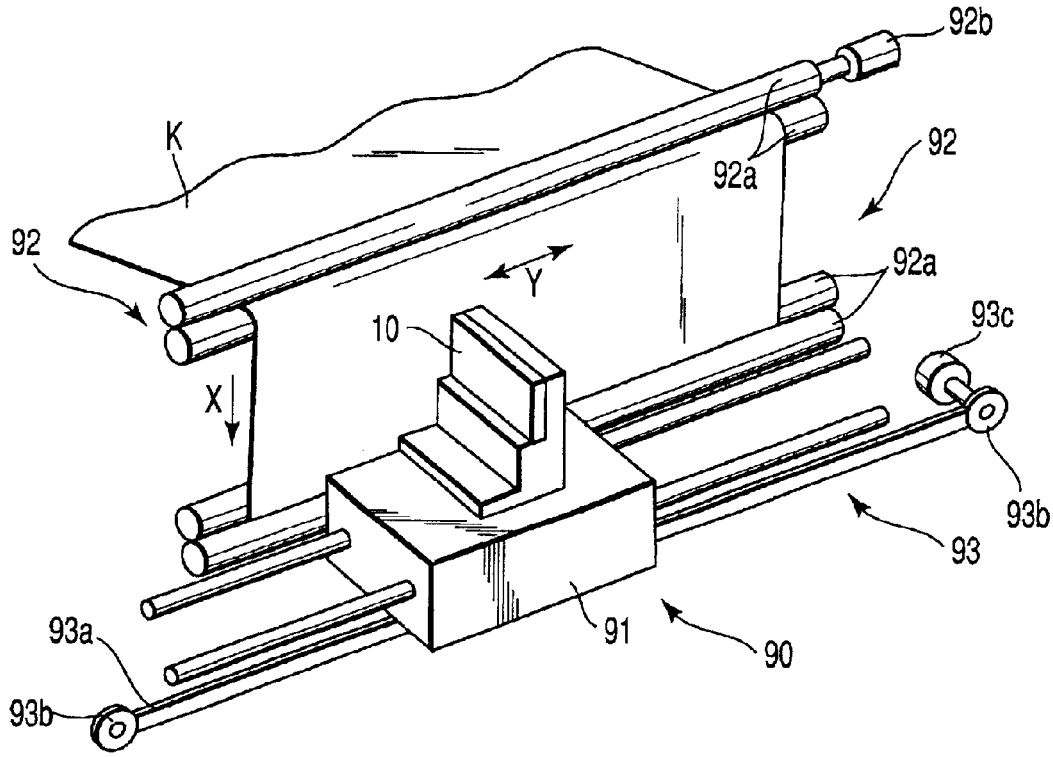
FIG. 1A is a schematic perspective view showing an ink jet printer having an ink head according to a first embodiment of the present invention.

FIG. 1A is a schematic perspective view of the ink jet printer 1 having an ink head 10 according to the first embodiment of the present invention.

The ink jet printer 1 comprises the ink head 10 and a scanning mechanism 90. The ink head 10 jets ink to a long recording medium K. The scanning mechanism 90 scans head 10 relative to the recording medium K in a main scanning direction and a sub-scanning direction. In FIG. 1A, the main scanning direction is indicated by an arrow mark Y and the sub-scanning direction by an arrow mark X.

The scanning mechanism 90 has a carriage 91, recording medium conveying means 92 and driving means 93. The carriage 91 is fixed with the ink head 10. The recording medium conveying means 92 conveys the recording medium K in order in the sub-scanning direction. The driving means 93 drives the carriage 91 in the main scanning direction.

The recording medium conveying means 92 has a pair of conveying rollers 92*a* and a line feed motor 92*b*. The pair of conveying rollers 92*a* are separated up and down. The line feed motor 92*b* is connected to one of the pair of conveying rollers 92*a*. Further, the line feed motor 92*b* rotationally drives the connected conveying roller 92*a* so that the recording medium K is conveyed in the sub-scanning direction X. That is, the recording medium K is conveyed in order along the sub-scanning direction by the drive of the line feed motor 92*b*.

The driving means 93 comprises a wire 93*a*, a pair of pulleys 93*b* and a carriage motor 93*c*. The wire 93*a* is connected to the carriage 91. The pair of pulleys 93*b* cross-links the wire 93*a* along the scanning direction. The carriage motor 93*c* is connected to one of the pair of pulleys 93*b*. Accordingly, the carriage 91 is moved along the main scanning direction by the drive of the carriage motor 93*c*.

The ink jet printer 1 has a platen for preventing the recording medium K from approaching to the ink head. The platen holds the recording medium K by a negative pressure. In this way, the platen keeps a constant space between the front surface of the ink head 10 and the recording medium K.

In the ink jet printer 1, the ink head 10 is moved in the main and sub-scanning direction relative to the recording medium K. Followed by this movement, the ink head 10 records an image by jetting ink. At this time, the ink head 10 keeps a constant space with respective to the recording medium K as described above.

The ink jet printer 1 has a maintenance mechanism (not shown) for performing a maintenance process of the ink head 10. The maintenance mechanism has a cap, sucking means and a wiper blade similarly to the maintenance mechanism described in the Description of the Related Art. The maintenance mechanism performs the maintenance process in a maintenance station arranged before the ink head 10 records the image.

In this maintenance process, the maintenance mechanism performs a purging operation and a wiping operation. The purging operation is an operation to suck contaminants (dust and bubbles) inside a nozzle and/or an ink chamber together with ink. The wiping operation is an operation to eliminate ink remained on a nozzle-forming surface (a front surface of the ink head).

The purging operation caps a plurality of nozzles of the ink head 10 and suck the ink. In the wiping operation, the wiper blade wipes out a large amount of waste ink 80 remained on the nozzle-forming surface.

The ink head 10 attached to the ink jet printer 1 will be described in details as follows. FIG. 1B is a perspective view showing the ink head 10 according to the first embodiment of the present invention.

The ink head 10 has an ink head module 20 and a nozzle plate 30.

The ink head module 20 has a plurality of ink chambers along its longitudinal axis at a predetermined pitch. Note that, in each ink chamber, an ink-ejecting port to eject ink is provided. The ink-ejecting port is arranged along the longitudinal axis of the ink head module 20. The ink head module 20 is connected to an ink tank via a tube (not shown) to be a liquid path. The ink tank is arranged inside the ink jet printer 1. In this way, each ink chamber can be supplied with ink from tank. Each ink chamber has a known jet energy generating means (not shown) such as, for example, a piezo element. The jet energy generating means applies a force necessary for jet to the ink at an ink jetting time.

In this way, the ink head module 20 can eject the ink from the ink-ejecting port of the surface (the front surface) opposing to the recording medium K.

The nozzle plate 30 has a plurality of nozzles 31. Each nozzle 31 is provided to the ink-ejecting port of each ink chamber. To be more specific, each nozzle is correctly aligned to a position of the ink-ejecting port of each ink chamber. Accordingly, the nozzles 31 are aligned along the longitudinal axis of the nozzle plate 30. The ink head 10 can jet the ink inside the ink chamber as an ink dot.

The ink head module 20 further has ribs 21*a*. The rib 21*a*, when the recording medium K is lifted from the platen, prevents the lifted recording medium K from contacting the nozzle 31. Hereinafter, referring to FIGS. 1B and 2A to 2E, the rib 21*a* will be described.

Figure 1B:
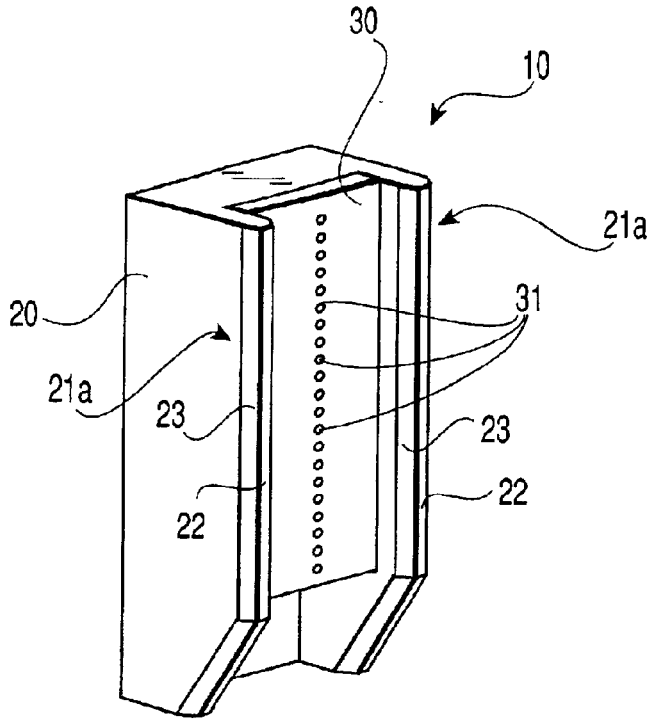
FIG. 1B is a perspective view showing the ink head according to the first embodiment of the present invention.
Figure 2A:
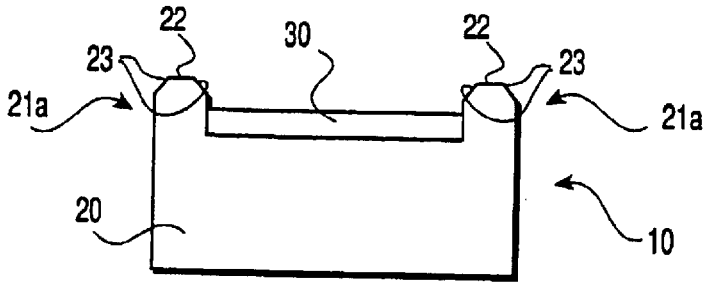
FIG. 2A is a top view showing the ink head of FIG. 1B.
Figure 2B:
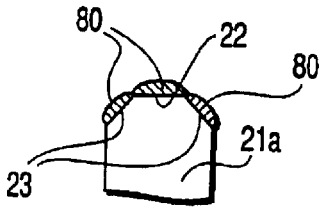
FIG. 2B is an enlarged view showing a distal end of a rib of FIG. 2A.
Figure 2C:
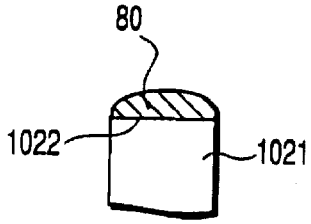
FIG. 2C is an enlarged view showing a distal end of a rib of a conventional ink jet printer.

FIG. 2A is a top view showing the ink head 10 of FIG. 1B. FIG. 2B is an enlarged view showing a distal end of the rib 21*a* of FIG. 2A. FIG. 2C is an enlarged view showing a distal end of a rib 21*a* of a conventional ink jet printer.

A pair of ribs 21*a* is provided at both sides of the ink head module along the longitudinal axis of the ink head module 20. The rib 21*a* projects perpendicular to the front surface of the nozzle plate. In other words, the rib 21*a* projects toward the recording medium K. The rib 21*a* has a plane 22 at a distal end of the rib 21*a*. The distal end is an upper potion of the rib 21*a*. The rib 21*a* has a lower end portion on the side of the nozzle plate. The lower end portion is a proximal end of the rib 21*a*. The plane 22 is opposed to the recording medium K. The longitudinal both sides of the plane 22 are chamfered. Therefore, the rib 21*a* has inclined planes 23 at both sides of the plane 22. Hence, the rib 21*a* is smaller in the area of the plane 22 than a plane 1022 of conventional rib shown in FIG. 2C. The rib 21*a* is smaller in the area of surface that is parallel to the surface of the recording medium K than the rib 1021. Accordingly, the rib 21*a* as shown in FIG. 2B reduces the amount of waste ink 80 to remain on the plane 22 smaller than that of the conventional rib. Therefore, the height of the waste ink 80 swollen from the plane 22 is lower than the height of the waste ink 80 swollen from the plane of the distal end in the conventional rib shown in FIG. 2C. By the constitution, the rib 21*a* can reduce a possibility of the contact between the recording medium K and the waste ink 80. That is, the rib 21*a* can prevent the contamination of the recording medium K by the waste ink 80 which remains on the ink head after the purging operation. Even when the waste ink 80 remains on the recording medium K, since the amount of waste ink 80 on the distal end of the rib is small, a degree of contamination can be suppressed.

Figure 2D:
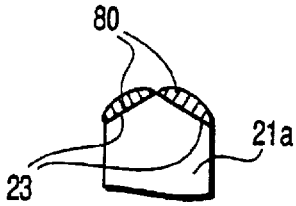
FIG. 2D is an enlarged view showing a modification of the rib according to the first embodiment.

The distal end of the rib 21*a* can form the chamfered portion larger. For example, as shown in FIG. 2D, the distal end of the rib 21*a* does not form the plane 22 parallel to the recording medium K, but can be configured only by the inclined planes 23. In this case, the waste ink 80 remains only on the inclined planes 23 of the distal end. Accordingly, this rib 21*a* can lower the height of the waste ink 80 swollen from the distal end of the rib than the case where it has the plane 22. Accordingly, the rib 21*a* can further lower the possibility of the contact between the recording medium K and the waste ink 80.

Figure 2E:
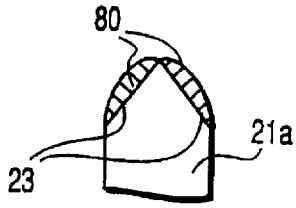
FIG. 2E is an enlarged view showing a modification of the rib according to the first embodiment.

As shown in FIG. 2E, the rib 21*a* can allow the distal end to have an angle acuter than the rib 21*a* shown in FIG. 2D. In this case, the rib 21*a* of FIG. 2E can allow the height of the waste ink 80 which projects from the top of the rib (apex angular portion) to be still lower than that of the rib 21*a* of FIG. 2D. Accordingly, even when the waste ink 80 remains on the inclined plane 23 of the distal end, the rib 21*a* of FIG. 2E can reduce further the possibility of the contact between the waste ink 80 and the recording medium K.

Note that, in the present embodiment, though the projecting direction of the rib 21*a* is perpendicular to the front surface of the nozzle plate 30, the projecting direction of the rib 21*a* is optional. However, it is necessary for the projecting direction to satisfy the following two conditions. The first condition is that the rib 21*a* projects in the direction which can prevent the contact between the recording medium K swollen from the platen and the nozzle 31. The second condition is that the rib 21*a* formed with the distal end extends in the direction that can reduce the area of a plane parallel to the recording medium K.

It is possible for the rib 21*a* not to be continuously arranged along the longitudinal axis of the ink head 10, but to be arranged so as to be discontinuously distributed. That is, the rib 21*a* is not limited in the arrangement. It is also possible for the rib 21*a* not to be integrally formed with the ink head 10, but to be separately formed and, then, to be connected to the ink head 10. The rib 21*a* can be formed on the nozzle plate 30. That is, the rib according to the present embodiment is not limited in its constitution provided that the following conditions are satisfied. The first condition is that the rib 21*a* can prevent the contact between the recording medium K swollen from the platen and the nozzle 31. The second condition is that the distal end of the rib 21*b* is tapered so that the plane parallel to the surface of the recording medium K is reduced.

Second Embodiment

Figure 3A:
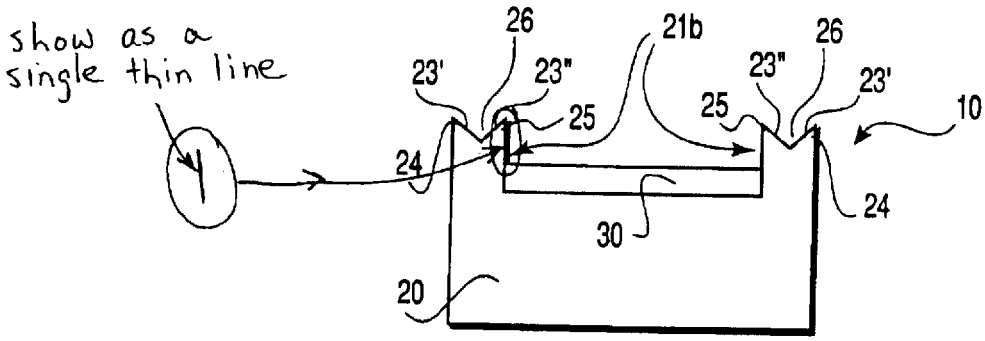
FIG. 3A is a top view showing an ink head according to a second embodiment of the present invention.

Hereinafter, an ink jet printer 1 according to a second embodiment of the present invention will be described with reference to FIGS. 3A to 3C. Note that, in the present embodiment, the same constitutional members as those of the ink jet printer 1 according to the first embodiment are indicated by using the reference numerals which indicate the same constitutional members as those of the ink jet printer 1 and the detailed description thereof will be omitted. FIG. 3A is a top view showing an ink head 10 according to the present embodiment.

The ink head 10 according to the present embodiment is different in the constitution of the distal end of the ink head 10 according to the first embodiment. The rib 21*b* of the ink head 10 according to the present embodiment 10 has two distal ends 24 and 25. The distal end 24 is an outer distal end with respective to the nozzle plate 30. The distal end 24 has an inclined plane 23'. The distal end 25 is a distal end of the side of the nozzle plate 30 (inner side). The distal end 25 has an inclined plane 23". The rib 21*b* has a rib groove 26 in a V shape which is constituted by the inclined plane 23' and the inclined plane 23". The rib groove 26 is provided along the longitudinal axis of the rib 21*b*. The rib groove 26 receives the waste ink 80, which is remained on the distal end of the rib. The waste ink 80 once received inside the V-shaped rib groove 26 does not flow toward the distal end of the rib by its surface tension. That is, the received waste ink 80 is kept inside the rib groove 26 or drops downward in a vertical direction by being leaded by the rib groove 26.

Figure 3B:
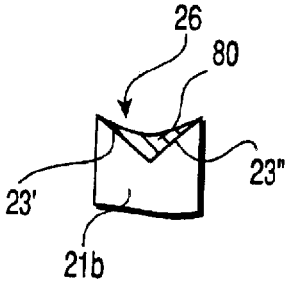
FIG. 3B is an enlarged view showing a distal end of a rib of FIG. 3A.
Figure 3C:
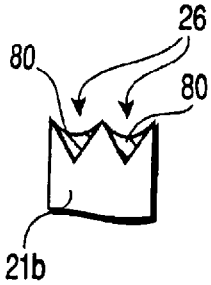
FIG. 3C is an enlarged view showing a modification of the rib according to the second embodiment.

By the constitution, as shown in FIG. 3B, the rib 21*b* eliminates the projecting of a collection of the waste ink 80 from the distal end. Even when the waste ink 80 projects from the distal end of the rib, the rib 21*b* can largely reduce the height of the waste ink 80 from the distal end of the rib in contrast to the conventional rib. Accordingly, the rib 21*b* can reduce the possibility of the contact between the recording medium K and the waste ink 80.

The rib 21*b* according to the present embodiment has two distal ends. However, it is possible for the rib 21*b* to have three distal ends as shown in FIG. 3C and to have two rib grooves. That is, in the rib 21*b*, only when at least one distal end is tapered, the number of distal ends and the number of rib grooves are optional.

Third Embodiment

Figure 4A:
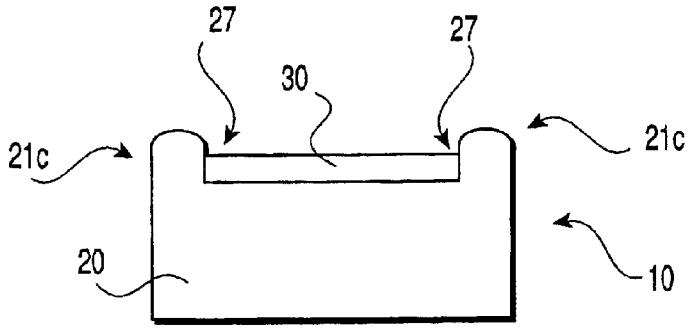
FIG. 4A is a top view showing an ink head according to a third embodiment of the present invention.
Figure 4B:
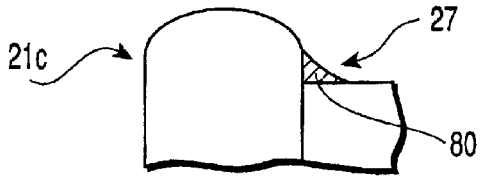
FIG. 4B is an enlarged view showing a distal end of a rib of FIG. 4A.

Hereinafter, an ink jet printer 1 according to a third embodiment of the present invention will be described with reference to FIGS. 4A and 4B. Note that, in the present embodiment, the same constitutional members as those of the ink jet printer 1 according to the first embodiment are indicated by using the reference numerals which indicate the same constitutional members as those of the ink jet printer 1 and the detailed description thereof will be omitted. FIG. 4A is a top view showing an ink head 10 according to the present embodiment.

The ink head 10 according to the present embodiment is different from the ink head 10 according to the first embodiment in the constitution of the distal end of the rib. A rib 21*c* of the ink head 10 is subjected to R process along the longitudinal axis of the ink head 10. In other words, the rib 21*c* has a curve, which becomes thinner toward the distal end. As used herein, the term "R process" refers to a process for rounding an edge. In this way, as shown in FIG. 4B, the rib 21*c* can let the waste ink 80 flowed toward an angular portion 27 (a proximal end of the rib 21*c*) which is constituted by the rib 21*c* and the nozzle plate 30.

With this construction, the rib 21*c* eliminates the collection of the waste ink 80 in the distal end. And the rib 21*c* prevents the waste ink 80 from projecting from the distal end. Even when the waste ink 80 collects in the distal end, the rib 21*c* can largely reduce the height of the swelling waste ink 80 from the distal end in contrast to the conventional case.

The waste ink 80 flowed from the distal end of the rib 21*c* collects in the angular portion 27 by its own surface tension. The waste ink 90 does not flow from the angular portion 27 to the distal end of the rib 21*c*. Accordingly, the waste ink 80 is held by the angular portion 21 or drops down in a vertical direction by being led by the angular portion 27. Accordingly, the amount of waste ink 80 remaining on the distal end can be significantly reduced. Accordingly, the rib 21*c* can reduce the possibility of the contact between the waste ink 80 and the recording medium K.

Note that, in the present embodiment, the rib 21*c* is curved in its entirety. Note that the rib 21*c* can have only a partially curved surface. When the rib 21*c* has at least a partially curved surface so as to be tapered toward the distal end, there is no limit in its form. However, it is preferable that the rib 21*c* has a curved surface toward the nozzle plate 30 so that the waste ink 80 can flow to the angular portion 27.

Fourth Embodiment

Figure 5A:
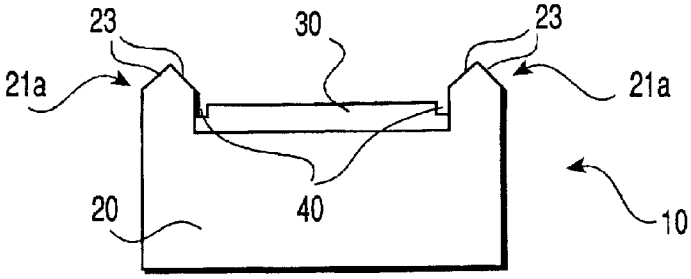
FIG. 5A is a top view showing an ink head according to a fourth embodiment of the present invention.

Hereinafter, an ink jet printer according to a fourth embodiment of the present invention will be described with reference to FIGS. 5A and 5B. Note that, in the present embodiment, the same constitutional members as those of the ink jet printer 1 according to the first embodiment are indicated by using the reference numerals which indicate the same constitutional members as those of the ink jet printer 1 and the detailed description thereof will be omitted. FIG. 5A is a top view showing an ink head 10 according to the present embodiment.

The ink head 10 according to the present embodiment is different from the ink head 10 of the first embodiment in the constitution of the nozzle plate.

A nozzle plate 30 according to the present embodiment is provided with a side portion groove 40 along the longitudinal axis of the ink head 10. The side portion grooves 40 are notches of both side portions of the nozzle plate 30. In other words, the side portion groove 40 is provided along the proximal end of the rib 21*a*. The side portion groove 40 is formed by the rib 21*a* and the notch. This side portion groove 40 has a sectional rectangular shape.

Figure 5B:
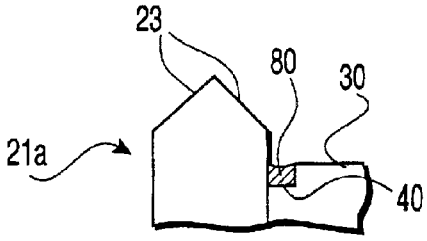
FIG. 5B is an enlarged view showing a periphery of a rib of FIG. 5A.

By the constitution, as shown in FIG. 5B, the waste ink 80 remains on the inclined plane 23 of the distal end and the side wall of the rib 21*a*. the waste ink 80 flows down to the proximal end of the rib 21*a*. The flowed waste ink is received inside the side portion groove 40. The waste ink 80 once received inside the side portion groove 40 will never flow outside of the side portion groove 40 by its surface tension. Note that, when the large amount of waste ink 80 flows into the side portion groove 40, the waste ink 80 flows downwardly in a vertical direction along the side portion groove 40. In this way, the side portion groove 40 for use of the waste ink 80 is formed on the nozzle plate. Thereby, the waste ink 80 remained on the rib 21*a* and on the nozzle plate 30 can be received by the side portion groove 40. Accordingly, the ink head 10 according to the present embodiment can reduce the amount of waste ink 80 on the distal end of the rib 21*a* and on the nozzle plate 30. Accordingly, the ink head 10 according to the present embodiment can reduce the possibility of the contact between the waste ink 80 and the recording medium K.

Note that, in the present embodiment, the side portion groove 40 is formed by the notch of the nozzle plate 30 and the rib 21*a*. The side portion groove 40 can be formed so as to be configured only by the nozzle plate 30 in the vicinity of the proximal end of the rib 21*a*. Further, the side portion groove can be formed such that the both side portions of the nozzle plate 30 are configured so as be separated from the proximal end of the rib 21*a* with a predetermined distance. In other words, the side portion groove 40 can be made by a gap between the side surface of the nozzle plate 30 and the rib 21*a*. In this case, the nozzle plate 30 has no need to provide the notch for the side portion groove 40.

Although the side portion groove 40 is formed in the sectional rectangular shape, it is also possible to make it into a shape having a curved line or other polygonal shape. That is, the side portion groove 40 is not limited in the form provided that the following conditions are satisfied. The first condition is that the side portion groove 40 can receive the waste ink 80, which flows in the vicinity of the proximal end of the rib 21*a*. The second condition is that the side portion groove 40 can lead the movement of the waste ink 80.

Fifth Embodiment

Figure 6A:
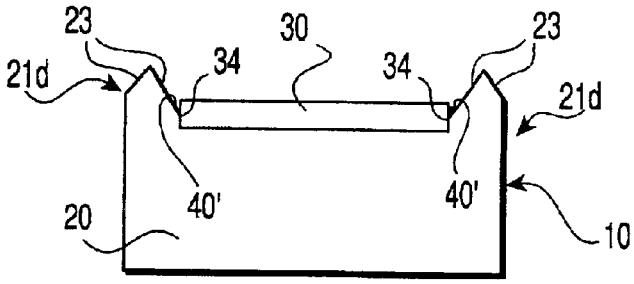
FIG. 6A is a top view showing an ink head according to a fifth embodiment of the present invention.

Hereinafter, an ink jet printer 1 according to a fifth Embodiment of the present invention will be described with reference to FIGS. 6A and 6B. Note that, in the present embodiment, the same constitutional members as those of the ink jet printer 1 according to the first embodiment are indicated by using the reference numerals which indicate the same constitutional members as those of the ink jet printer 1 and the detailed description thereof will be omitted. FIG.

6A is a top view showing an ink head 10 according to the present embodiment.

The ink head 10 according to the present embodiment is different from the ink head 10 of the first embodiment in the constitution of the rib.

Figure 6B:
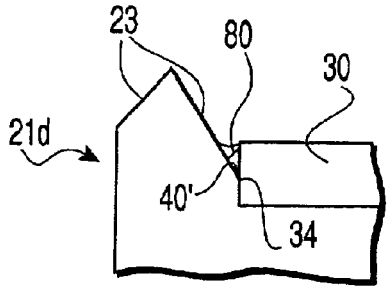
FIG. 6B is an enlarged view showing a periphery of a rib of FIG. 6A.

A rib 21*d* of the present embodiment has two inclined planes 23 as shown in FIG. 6B. One of inclined plane 23 is located on the nozzle plate 30 side. The inclined plane 23 of the side of the nozzle plate 30 extends till a side surface 34 of the nozzle plate 30. The inclined plane 23 and the side surface 34 form a side portion groove 40'. In other words, the side portion groove 40' is configured in such a manner that a part of the inclined plane 23 extending from the distal end of the rib 21*d* is on the same plane as side surface of the groove 40'.

By the constitution, the waste ink 80 remaining on the distal end is lead to the groove 40' by the inclined plane 23. The waste ink 80 is directly received into the side portion groove. Accordingly, the rib 21*d* can easily lead the waste ink 80 toward the side portion groove 40'. That is, the ink head 10 according to the present embodiment has only one inclined plane interposed in a space from the distal end of the rib 21*d* to the side portion groove 40'. Accordingly, there exists no interference in the space from the distal end of the rib 21*d* to the side portion groove 40'. For this reason, the ink head 10 can easily lead the waste ink 80.

The waste ink 80 once received into the side portion groove 40' will never flow out from inside the groove to the outside by its surface tension. That is, the waste ink 80 drops only downward in a vertical direction. Accordingly, the waste ink 80 is received inside the side portion groove 40'. For this reason, this ink head 10 can reduce a risk of the contact between the waste ink 80 and the recording medium K.

Note that, in the present embodiment, the inclined plane 23 of the side of the nozzle plate 30 (inner side) has a sharp angle with respective to the plane of the recording medium K, while the inclined plane 23 of the outside has a gentle angle. However, the rib 21*d* can allow the angles to be the same with respective to the plane of the recording medium K. In other words, both of the inclined planes 23 can become bilaterally symmetrical. It is also possible for the rib 21*d* to constitute at least one slop by curved surface. Further, the rib 21*d* can be configured so as to have only the inner inclined plane 23. That is, when the rib 21*d* allows one inclined plane alone to interpose in the space from the distal end to the side portion grove 40' so that there exists no interference in the space, there is no limit in the shape of the rib 21*d*.

Sixth Embodiment

Figure 7:
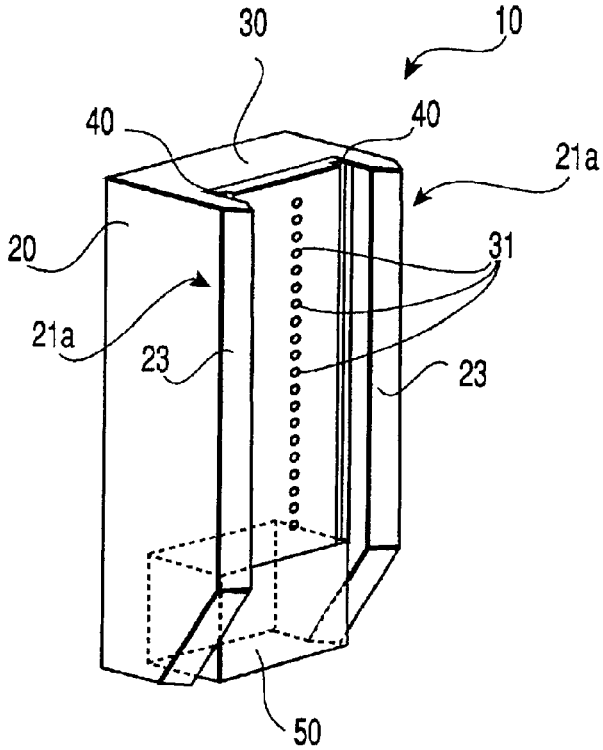
FIG. 7 is a perspective view showing an ink head according to a sixth embodiment of the present invention.

Hereinafter, an ink jet printer 1 according to a sixth embodiment of the present invention will be described with reference to FIG. 7.

Note that, in the present embodiment, the same constitutional members as those of the ink jet printer 1 according to the fourth embodiment are indicated by using the reference numerals which indicate the same constitutional members as those of the ink jet printer 1 and the detailed description thereof will be omitted. FIG. 7 is a perspective view showing an ink head 10 according to the present embodiment.

The ink head 10 according to the present embodiment has side portion grooves 40, 40 on the proximal end of the rib such as those described in the fourth and the fifth embodiments. The ink head 10 according to the present embodiment is characterized in that an ink absorber 50 is arranged so as to contact the end portions of the side portion grooves 40, 40. Note that, in the present embodiment, the description will be made by using the ink head 10 according to the fourth embodiment.

The ink head 10 according to the present embodiment has the ink absorber 50 to absorb the waste ink 80 downward in a vertical direction.

The ink absorber 50 has a rectangular shape with its upper surface formed in a plane shape. Thereby the upper surface of the ink absorber 50 closely contacts to the lower end of the ink head module 20. The ink absorber 50 is also arranged so that its front surface and the front surface of the nozzle plate 30 becomes one surface. In other words, the ink absorber 50 is attached to the ink head module 20 so that upper surface of the ink absorber 50 can completely cover the lower end portion of the side portion groove 40. The ink absorber 50 is known absorber which can absorb the ink. For example, the ink absorber 50 is a sponge.

The ink head 10 according to the present embodiment receives the waste ink 80 inside the side portion groove 40. The waste ink 80 inside the side portion groove 40 gradually flows downwardly in the vertical direction of the ink head by gravitation. The waste ink 80 collects in the lower end portion of the groove. When the amount of collected waste ink 80 becomes large, the waste ink 80 drops by its own weight. When the waste ink 80 drops, there is a risk that the waste ink 80 contaminates the apparatus. The ink head 10 according to the present embodiment has the ink absorber 50 in the lower end of the side portion groove 40. Accordingly, the waste ink 80 is leaded by the side portion groove 40. The waste ink 80 is absorbed by the ink absorber 50. For this reason, the ink head 10 can prevent the contamination of the recording medium K and the ink jet printer by the waste ink 80.

Note that, in the present embodiment, the ink absorber 50 has a rectangular shape and is provided only in one piece. Note also that the ink absorber 50 can provide the rectangular ink absorber in two pieces so as to correspond to each side portion groove 40. When the ink absorber 50 is arranged in the end portion of the side portion groove 40 and can absorb the waste ink 80 leaded by the side portion groove 40, there is no limit in its shape and its number.

Seventh Embodiment

Hereinafter, an ink jet printer 1 according to a seventh embodiment will be described with reference to FIGS. 8A to 8D.

Figure 8A:
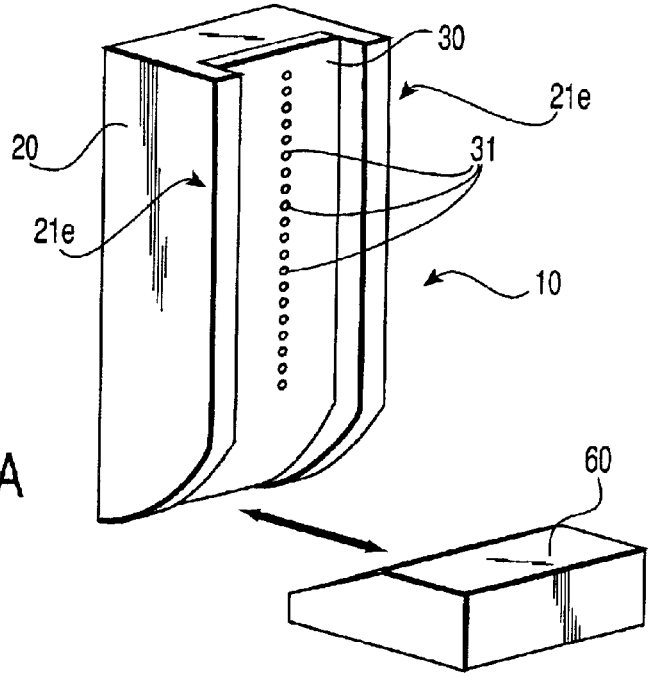
FIG. 8A is a perspective view showing an ink head according to a seventh embodiment of the present invention.

Note that, in the present embodiment, the same constitutional members as those of the ink jet printer 1 according to the first embodiment are indicated by using the reference numerals which indicate the same constitutional members as those of the ink jet printer 1 and the detailed description thereof will be omitted. FIG. 8A is a perspective view showing an ink head 10 according to the present embodiment.

The ink head 10 is different from the first embodiment in the constitutions of the rib and the nozzle plate.

A rib 21*e* has its distal end constituted by a plane surface similarly to the conventional rib. And a rib 21*e* is not tapered toward the distal end similarly to the conventional rib. The rib 21*e* is different in this point from the first embodiment. The rib 21*e* and the nozzle plate 30 are subjected to R process. Therefore, the front surface of each rib 21*e* and the nozzle plate 30 are curved to a buck surface of the head 10 gradually toward the lower end of the head 10. In other words, the rib 21*e* and the nozzle plate 30 are constituted so that the space between the recording medium K and themselves become larger as they go toward the head lower end. That is, the ink head 10 has a the curved surface. Needless to mention, the rib 21*e* can be tapered toward the distal end similarly to the each embodiment, and that is preferable.

An ink absorber 60 according to the present embodiment is different from the ink absorber 50 according to the sixth embodiment. The ink absorber 60 is arranged in the maintenance station such as that described in the first embodiment. Note that the ink head 10 is moved to the maintenance station by a moving mechanism as described above. The ink absorber 60 is mounted on an absorber moving mechanism (not shown) which is known moving means. For this reason, the ink absorber 60 can move so as to approach to/separate from the ink head in the maintenance station. In other words, ink absorber 60 is detachable from the ink head.

As shown by the constitution, the ink head 10 is subjected to R process so that the front surfaces of the rib 21*e* and the nozzle plate 30 curved to the buck surface of the head 10. Accordingly, the ink head 10 can keep the waste ink 80 in a position separated from the recording medium K.

Figure 8B:
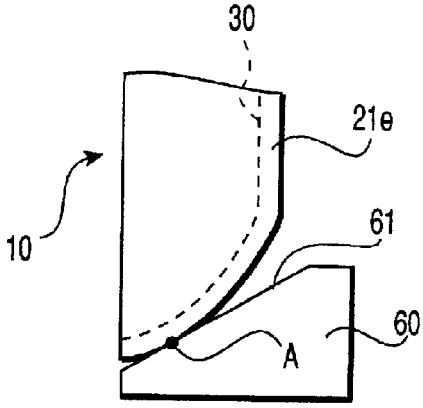
FIG. 8B is an enlarged view showing a distal end of a rib and an ink absorber according to the seventh embodiment.

The absorber 60 has the upper part of the distal end cut obliquely as shown in FIG. 8A. An angle with respective to the horizontal plane of the cutting of the absorber 60 becomes as much parallel as possible to a tangential line in the position separated from the recording medium K within the R processed portion of the front surfaces of the rib 21*e* and the nozzle plate 30. And at the same time, the angle is not parallel to the horizontal plane. That is, as shown in FIG. 8B, the ink absorber 60 has an inclined plane 61, which has an angle with respective to the horizontal plane. This inclined plane 61 is formed so as to be parallel to the tangential line of the R processed portion at a position A of FIG. 8B. This position A is a position having the largest space between the recording medium K and the R processed portion or in the vicinity thereof.

Figure 8C:
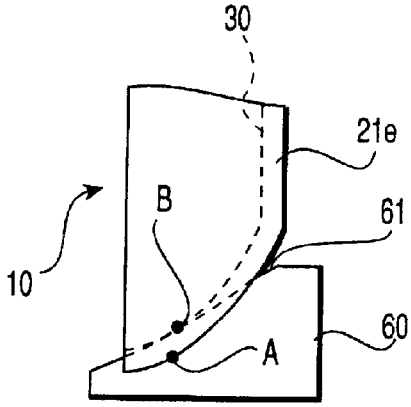
FIG. 8C is an enlarged view showing the distal end of the rib and the ink absorber according to the seventh embodiment.
Figure 8D:
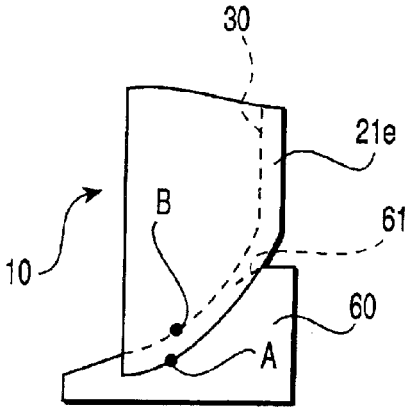
FIG. 8D is an enlarged view showing the distal end of the rib and the ink absorber according to the seventh embodiment.

Hereinafter, the case where the ink absorber 60 is moved so as to absorb the waste ink 80 on the ink head 10 will be described. When the ink absorber 60 is moved, the ink absorber 60 first contacts the ink head 10 at the position A shown in FIG. 8B. The ink absorber 60 absorbs the waste ink 80 which flows along the rib 21*e* and collects in the position A. The ink absorber 60 is moved in a direction to press against the ink head 10. When the ink absorber 60 is further moved, the portion against which the ink absorber and the rib 21*e* is gradually widened. In this way, the ink absorber 60 absorbs the waste ink 80 even in the vicinity of the position A of the rib 21*e*. When the ink absorber 60 is further moved, the ink absorber 60 also contacts a position of the nozzle plate 30 indicated by reference character B as shown in FIG. 8C. The ink absorber 60 absorbs the waste ink 80 of the position B. The ink absorber further moves toward the ink head 10 until a predetermined movement is achieved. Followed by this movement, the ink absorber 60 absorbs the waste ink 80, which is collected in the R processed portion of the rib 21*e* and the nozzle plate 30. Therefore, the ink absorber 60 can reduce the amount of waste ink 80 remained on the ink head 10. Accordingly, this ink head 10 can prevent the contamination of the recording medium K and the ink jet printer.

Note that, when the ink absorber 60 is in a state of reaching a predetermined movement, the ink absorber 60 has the contact portion with the position A of the rib. The contact portion with the position A is depressed most in the portion contacting the rib 21*e*. Further, the ink absorber 60 has the contact portion with the position B of the nozzle plate 30. The contact portion with the position B is depressed most in the portion contacting the nozzle plate 30 (see FIG. 8D).

When the ink absorber 60 reaches a predetermined movement, then, it moves to a reverse direction (a direction to separate from the ink head 10). At this time, the position where the ink absorber 60 and the nozzle plate 30 are brought into contact with each other to the last is the position B. Further, the position where the ink absorber 60 and the rib 21*e* are brought into contact with each other to the last is the position A. That is, the curved surface of the ink head 10 has a portion that finally separates from the ink absorber moving away from the ink head.

The ink absorber 60 can absorb a majority of the waste ink 80 in the portion contacting the rib 21*e* and the nozzle plate 30, but not completely. In other words, as far as the ink absorber 60 presses against the rib 21*e* and the nozzle plate 30, and then, separates from them, it inevitably creates a residual waste ink 80. Particularly, in the rib 21*e* and the nozzle plate 30, the residual waste ink becomes conspicuous in the portion to which the ink absorber 60 is brought into contact to the last.

In the present embodiment, ink absorber 60 is brought into contact with the rib 21*e*. In the contact, the ink absorber 60 has a portion where a crushed amount is the largest. The portion finally separates from the rib 21*e*. The portion is the portion where the ink absorber 60 abuts against position A as described above. This position A is in a position sufficiently separated from the recording medium K. Accordingly, if the residual waste ink 80 exists on the position A, a possibility of the contact between the waste ink 80 and the recording medium K is small. Similarly, ink absorber 60 is brought into contact with the nozzle plate 30. In the contact, the ink absorber 60 has a portion where a crushed amount is the largest. The portion finally separates from the nozzle plate 30. The portion is the portion where the ink absorber 60 abuts against position B as described above. This position B is in a position sufficiently separated from the recording medium K. For this reason, if the residual waste ink 80 exists on the position B of the nozzle plate 30, the possibility of the contact between the waste ink 80 and the recording medium K is small.

That is, the ink head 10 according to the present embodiment has a portion where a slight remain of the waste ink does not matter. The portion is in the rib 21*e* and nozzle plate 30. The absorber 60 is configured to finally separate from the portion. Therefore, the ink head according to the present embodiment can effectively absorb the waste ink 80 in a desired position (a position separated from the recording medium K).

Eight Embodiment

Figure 9A:
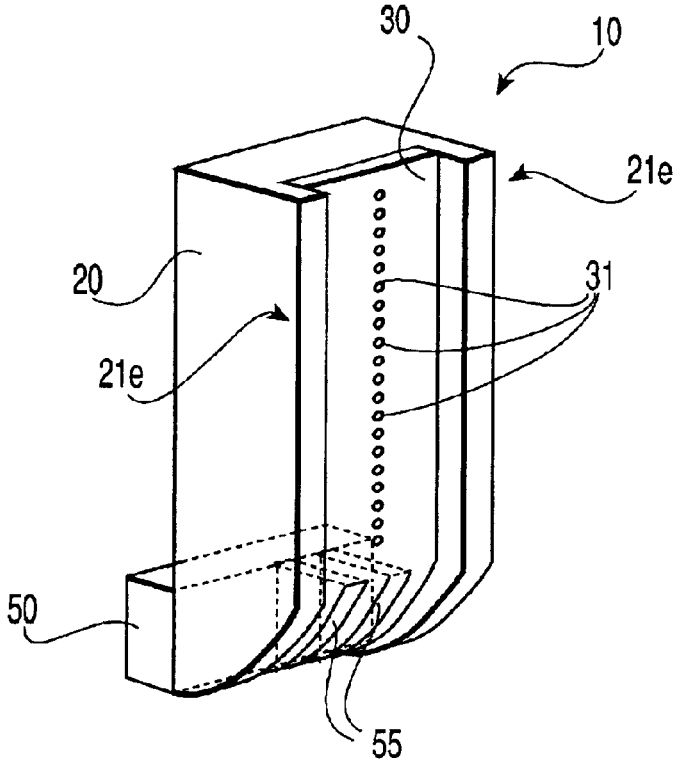
FIG. 9A is a perspective view showing an ink head according to an eighth embodiment of the present invention.
Figure 9B:
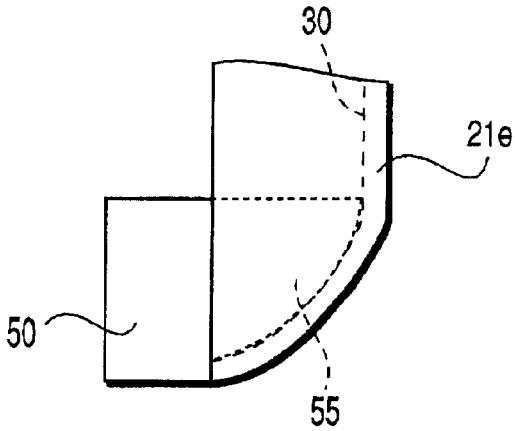
FIG. 9B is an enlarged view showing a distal end of a rib and an ink absorber according to the eighth embodiment.

Hereinafter, an ink jet printer 1 according to a eighth embodiment of the present invention will be described with reference to FIGS. 9A and 9B.

Note that, in the present embodiment, the same constitutional members as those of the ink jet printer 1 according to the seventh embodiment are indicated by using the reference numerals which indicate the same constitutional members as those of the ink jet printer 1 and the detailed description thereof will be omitted. FIGS. 9A and 9B are perspective views showing an ink head 10 according to the present embodiment.

In the ink head according to the present embodiment, the nozzle plate 30 is provided with two slits 55 which passes through until the back of the ink head 10. The back of the ink head 10 is provided with an ink absorber 50 having a size capable of covering the slit 55.

In the ink head 10 of the present embodiment, the waste ink 80 remained on the nozzle plate 30 gradually flow downward in a vertical direction. The waste ink 80 flows into the slit 55 formed on the nozzle plate 30. The waste ink 80 flowed into the inside of the slip 55 advances to the ink absorber 50 provided in the back of the ink head 10 by being leaded by the slit 55. Thus, the waste ink 80 is absorbed by the ink absorber 50. Therefore, this ink head 10 can prevent the downward dropping of the waste ink 80 from the lower part of the ink head. That is, this ink head 10 can reduce the amount of the remained waste ink 80 and prevent the contamination of the recording medium K and the ink jet printer. If R processing is subject to the boundary of the slit 55 and nozzle plate 30, the ink 80 is caused to flow into the slit 55 more smoothly.

Ninth Embodiment

Figure 10A:
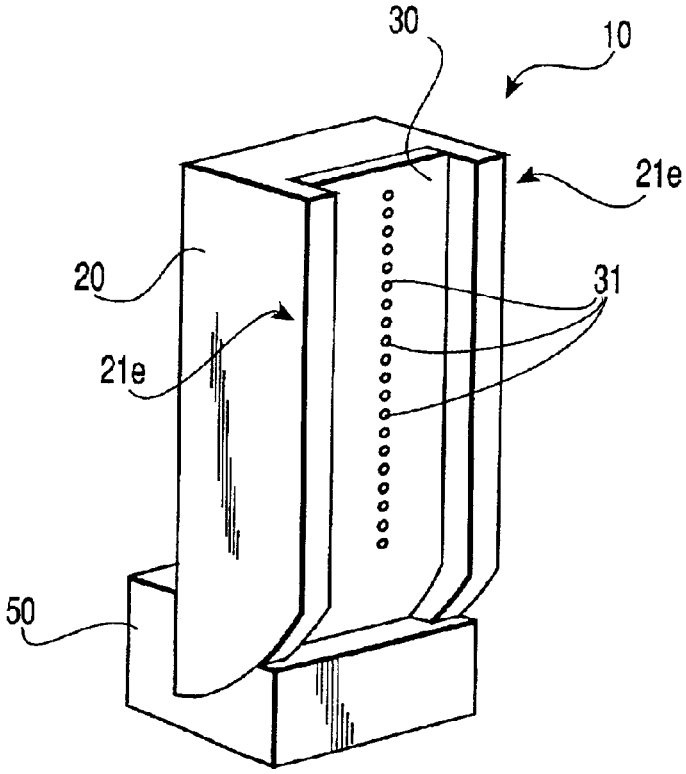
FIG. 10A is a perspective view showing an ink head according to a ninth embodiment of the present invention.

Hereinafter, an ink jet printer 1 according to a ninth embodiment of the present invention will be described with reference to FIGS. 10A and 10B.

Note that, in the present embodiment, the same constitutional members as those of the ink jet printer 1 according to the seventh embodiment are indicated by using the reference numerals which indicate the same constitutional members as those of the ink jet printer 1 and the detailed description thereof will be omitted. FIG. 10A is a perspective view showing an ink head 10 according to the present embodiment.

The ink head 10 according to the present embodiment have nearly L-shaped ink absorber 50 so as to nip its tapered lower part portion.

The ink absorber 50 has a plane being opposed to the back of the ink head 10. The plane is can closely contacts to the back of the ink head. Further, The ink absorber 50 has a back plane being opposed to the front surface of the ink head 10. The plane is can follows the shapes of the rib 21*e* and the nozzle plate 30. Accordingly, the ink absorber 50 can closely contacts to the ink head 10 until a predetermined position of the front surface of the ink head.

The predetermined position of the ink head front surface is a position which satisfies the following two conditions in the R processed portion of the front surface of the ink head 10. The first condition is that the position is arranged between the back of the ink head 10 and the distal end (the distal end of the rib in the direction toward the recording medium K) of the rib. The second condition is that the ink absorber 50 is in a position which can sufficiently absorb the waste ink 80 when the ink absorber 50 is arranged. That is, this position is a position where the waste ink 80 collects or in the vicinity thereof. Note that, in FIG. 10B, the predetermined position of the nozzle plate 30 is indicated by reference symbol C1, and the predetermined position of the rib 21*e* is indicated by reference symbol C2.

Figure 10B:
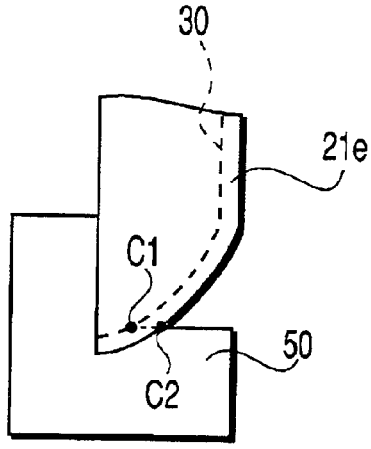
FIG. 10B is an enlarged view showing a distal end of a rib and an ink absorber according to the ninth embodiment.

As shown in FIG. 10B, the portion of the ink absorber 50 with which the front surface of the nozzle plate 30 is brought into contact is from the intersecting position where the back and front surfaces are intersected to a position C1. Further, the portion of the ink absorber 50 with which the front surface of the nozzle plate 30 is brought into contact is formed by curving along the form of the nozzle plate 30. Note that the ink absorber 50 horizontally extends to a position which does not exceed the distal end of the rib from the position C1 in the direction toward the recording medium K. Similarly, the portion of the ink absorber 50 with which the R processed portion of the rib 21*e* is brought into contact is from the intersecting position to the position C2. This ink absorber 50 has the portion, with which the R processed portion of the rib 21*e* is brought into contact, formed by curving along the form of the rib 21*e*. Further, this ink absorber 50 horizontally extends from the position C2 to the position which does not exceed the distal end of the rib in the direction toward the recording medium K.

By the constitution, the ink head 10 can reliably absorb the waste ink 80 by the ink absorber 50. Accordingly, the ink head 10 prevents the dropping downward of the waste ink 80 from the lower end of the ink head. Further, this ink head 10 can reduce the amount of the waste ink 80 remained on the ink head 10. This ink head 10 can prevent the contamination of the recording medium K and the ink jet printer.

Note that a modification of the present embodiment will be described with reference to FIGS. 10C and 10D, respectively.

Figure 10C:
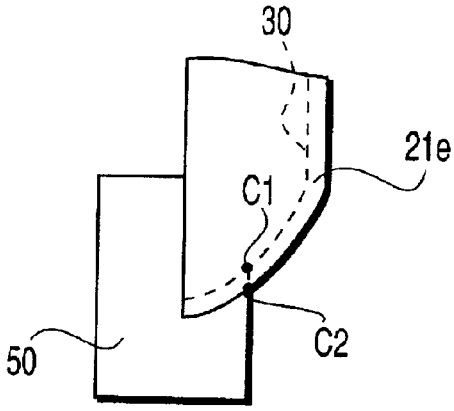
FIG. 10C is an enlarged view showing a distal end of a rib and an ink absorber according to a modification of the ninth embodiment.

FIG. 10C shows a longitudinal sectional view of a first modification. In this modification, the ink absorber 50 does not horizontally extend from the position C1 and the position C2. In other words, the ink absorber 50 stops a horizontal extension at the positions C1 and C2.

In this modification also, similarly to the tenth embodiment, the waste ink 80 which flows from the upper part of the head can be received by the ink absorber 50 and is not allowed to drop to the lower part of the ink head.

Figure 10D:
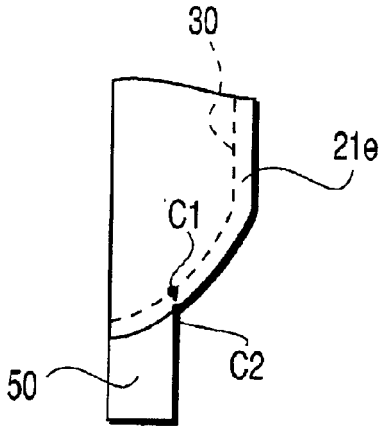
FIG. 10D is an enlarged view showing a distal end of a rib and an ink absorber according to a modification of the ninth embodiment.

FIG. 10D shows a longitudinal sectional view of a second modification. In an ink absorber 50 of the modification, the portion contacted closely to the back side of the ink head of the ink absorber 50 of the tenth embodiment is omitted.

In spite of having a small size, similarly to the tenth embodiment, the ink absorber 50 of this modification can absorb the waste ink 80 flowed from the upper part of the head and does not allow it to drop toward the lower part of the head.

Tenth Embodiment

Figure 11A:
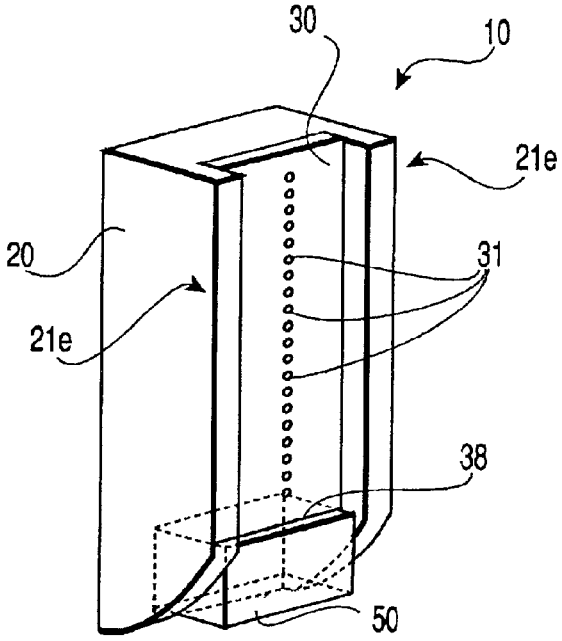
FIG. 11A is a perspective view showing an ink head according to a tenth embodiment of the present invention.
Figure 11B:
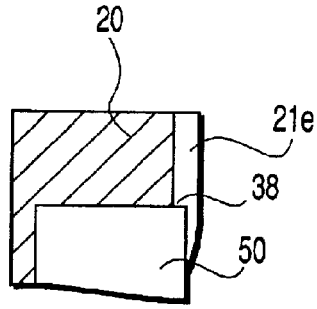
FIG. 11B is an enlarged view showing an angular portion according to the tenth embodiment.

Hereinafter, an ink jet printer 1 according to a tenth embodiment of the present invention will be described with reference to FIGS. 11A and 11B.

Note that, in the present embodiment, the same constitutional members as those of the ink jet printer 1 according to the seventh embodiment are indicated by using the reference numerals which indicate the same constitutional members as those of the ink jet printer 1 and the detailed description thereof will be omitted. FIG. 11A is a perspective view showing an ink head 10 according to the present embodiment.

The ink head 10 according to the present embodiment has the nozzle plate 30 formed flatly. A surface (a head bottom surface) orthogonal to the nozzle plate is formed at the lower end of the ink head 10.

The ink absorber 50 has a rectangular form with its upper surface formed flatly so that it can adhere closely to a space surrounded by the head bottom surface and two ribs 21*e*. The ink absorber 50 is arranged so as to project from the front surface of the nozzle plate 30 to a degree not to exceed the distal end of the rib 21*e* in the direction toward the recording medium K.

By the constitution, the ink absorber 50 is arranged so as to contact an angular portion 38 of the lower end of the nozzle plate 30. Nevertheless, the ink absorber 50 slightly projects toward the recording medium K rather than toward the angular portion 38. Therefore, the waste ink 80, which drops on the nozzle plate 30, surely reaches the ink absorber 50 and is absorbed by it. That is, the ink head 10 according to the present embodiment is fixed to the head so that a sponge as the ink absorber contacts the angular portion formed by the lower end of the flat surface of the nozzle plate 30 and the other surface which intersects the lower end. For this reason, the waste ink 80, which drops on the nozzle plate 30, is surely absorbed by the sponge.

Note that the ink head 10 according to the present embodiment is preferably constituted in such a manner that the ink absorber 50 is pressed against the head bottom surface so that a space is not created between the angular portion 38 and the ink absorber 50.

Figure 11C:
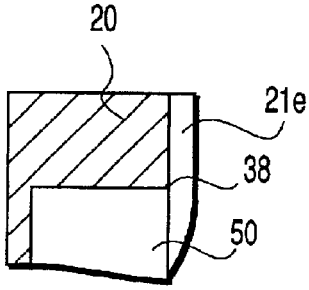
FIG. 11C is an enlarged view showing an angular portion of a modification according to the ninth embodiment.

Note that a modification of the present embodiment will be described with reference to FIGS. 11C, 11D and 11E, respectively FIG. 11C shows a longitudinal sectional view of a first modification. This modification is constituted in such a manner that the surface of the ink absorber 50 opposing to the recording medium K becomes one flat surface with the flat surface of the nozzle plate.

Figure 11D:
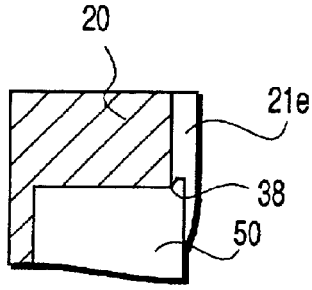
FIG. 11D is an enlarged view showing an angular portion of a modification according to the ninth embodiment.

FIG. 11D shows a longitudinal sectional view of a second modification. In this modification, the ink absorber 50 has a projected portion so as to cover the angular portion 38.

Figure 11E:
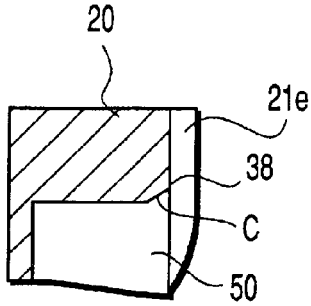
FIG. 11E is an enlarged view showing an angular portion of a modification according to the ninth embodiment.
Figure 12A:
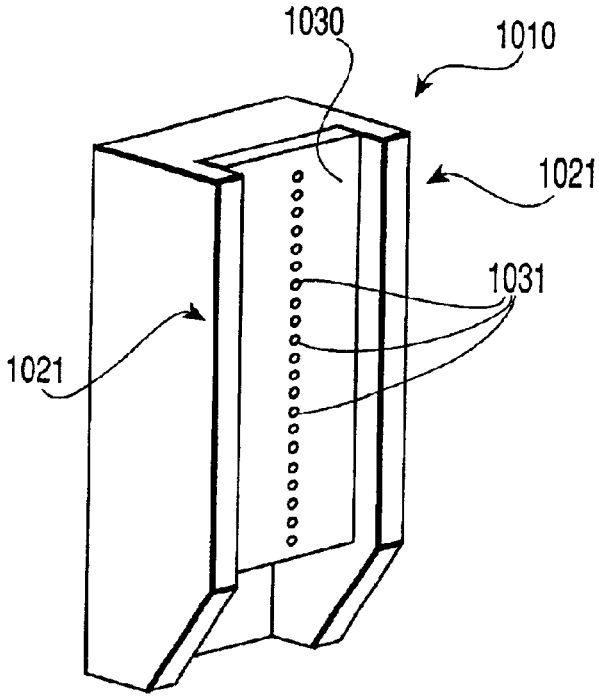
FIG. 12A is a perspective view showing a conventional ink head.
Figure 12B:
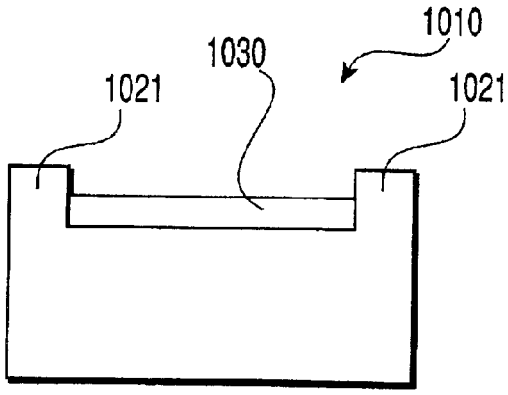
FIG. 12B is a top view of the ink head of FIG. 12A.
Figure 12C:
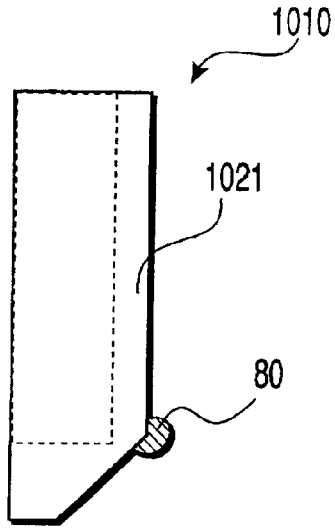
FIG. 12C is a side view of the ink head of FIG. 12A.

FIG. 11E shows a longitudinal sectional view of a third modification. This modification proposes an ink absorber having an effective shape when a chamfered portion 39 is formed in the angle portion which is made by the nozzle head and the head bottom surface.

The angular portion 38 of the ink head 10 in FIG. 11E is configured by the flat surface of the nozzle plate 30 and the chamfered portion C. By arranging the ink absorber 50 on the ink head so as to closely contact on this angular portion 38, the ink head 10 in FIG. 11E has the same effect as the present embodiment and the each modification. The ink head in FIG. 11E can be processed by chamfered process or by the R process.

Eleventh Embodiment

Hereinafter, an ink jet printer 1 according to an eleventh embodiment of the present invention will be described.

In the present embodiment, the same constitutional members as those of the ink jet printer 1 according to the seventh embodiment are indicated by using the reference numerals which indicate the same constitutional members as those of the ink jet printer 1 and the detailed description thereof will be omitted.

The present embodiment aims at a timing in which the ink absorber 60 absorbs the waste ink 80. Note that the ink absorber is movable such as described in the seventh embodiment.

The ink jet printer 1 according to the present embodiment controls the driving of the absorber moving mechanism. That is, the driving of the ink absorber 60 is controlled by the maintenance mechanism. Therefore, in the maintenance process of the present embodiment, the maintenance mechanism performs a waste ink absorbing operation, the purging operation and the wiping operation. This waste ink absorbing operation is an operation to absorb the waste ink 80 by bringing the ink absorber 60 into contact with the ink head 10.

Note that the waste ink absorbing operation is performed at the end of the maintenance process. Hereinafter, the reason why the waste ink absorbing operation is performed at the end of the maintenance process will be described.

The maintenance process performs the purging operation in the first, the wiping operation in the second and the maintenance operation in the third. In the purging operation, the cap covering a nozzle 31 is filled with the ink. Accordingly, the front surface of this nozzle plate 30 is extremely contaminated by the waste ink 80. The waste ink 80 remained on the front surface of this nozzle plate 30 is wiped out by a rubber blade by the subsequent wiping operation. However, even when the wiping operation is performed, the waste ink 80 is not wiped out completely on the front surface of the nozzle plate 30. Accordingly, in the present embodiment, the maintenance mechanism performs the waste ink absorbing operation after the maintenance ejection. In other words, the waste ink absorbing operation is performed at the end of the maintenance process.

Note that the waste ink 80 on the front surface of the nozzle plate 30 gradually flows toward the ink head lower end. However, when a longitudinal length of the ink head 10 is long, the waste ink 80 takes time until it collects in the lower end of the ink head. In other words, in order for the waste ink 80 to reach a position of the ink absorber 60 arranged in the lower end of the ink head, a certain time has to elapse from the purging operation. Accordingly, it is preferable that the waste ink absorbing operation is performed at the end of the maintenance process in order to save a certain time from the purging operation.

Accordingly, the ink head 10 according to the present embodiment can save enough time from the purging operation by performing the waste ink absorbing operation at the end of the maintenance process. For this reason, the waste ink 80 can be collected at the ink head lower end. Accordingly, the ink absorber 60 can effectively absorb the waste ink 80 just by contacting the ink head lower end. Note that, when the ink absorber 60 absorbs the waste ink 80, it is preferable that the ink absorber 60 contact only the vicinity of the ink head lower end so that the portion where the nozzle is formed is not contaminated.

The waste ink absorbing operation preferably is performed just before starting printing. Specifically, The waste ink absorbing operation preferably is performed after a timing at which readiness of recording medium achieves completion, or at which data transfer achieves completion.

Twelfth Embodiment

Hereinafter, an ink jet printer 1 according to a twelfth embodiment of the present invention will be described.

In the present embodiment, the same constitutional members as those of the ink jet printer 1 according to the eleventh embodiment are indicated by using the reference numerals which indicate the same constitutional members as those of the ink jet printer 1 and the detailed description thereof will be omitted.

The ink jet printer 1 according to the present embodiment is different from the ink jet printer 1 according to the first embodiment in performing the waste ink absorbing process during the image recording operation. Note that the term "during the image recording operation" used here indicates a time required for duration from starting the recording of an image on the recording medium K by the ink jet printer to the completion of the recording of the entire image.

As described in the eleventh embodiment, it takes time for the waste ink 80 to reach an absorbing position where the ink absorber 60 is arranged. Accordingly, the ink jet printer 1 according to the present embodiment is operated after the maintenance process is completed and the image recording is actually started. To be more specific, when the waste ink 80 reaches the absorbing position during the image recording operation, the waste ink absorbing operation is performed. Note that this ink absorbing operation is performed once the ink head 10 is returned to the maintenance station when the waste ink 80 reaches the position. Therefore, the waste ink 80 is collected securely in the absorbing position. Accordingly, the ink jet printer 1 according to the present embodiment can effectively absorb the waste ink 80. At the same time, the ink jet printer 1 can perform other operations until the waste ink 80 reaches the absorbing position. For this reason, the ink jet printer 1 can effectively perform the operation.

Note that, among the conventional ink jet printers, there are available those printers, which move the ink head to the maintenance station during the image recording. However, the ink jet printer 1 according to the present embodiment is different from those printers. The ink jet printer of the present embodiment absorbs the waste ink 80 by the ink absorber 60 strictly at the right time when the waste ink was sufficiently collected in the lower end. The ink jet printer of the present embodiment aims to perform this waste ink absorbing operation only during the recording operation. Accordingly, even when the ink head 10 returns to the maintenance station, the purging operation and the wiping process which newly generate the waste ink 80 are not performed. That is, the ink absorber 60 only abuts against the head lower end.

In the present embodiment too, similarly to the eleventh embodiment, the ink absorber is abutted against the head lower end in a state of the waste ink 80 being sufficiently collected in the head lower end. Accordingly, it is possible to effectively absorb the waste ink 80. Further, in the present embodiment, it is also possible for the ink absorber 60 to absorb the waste ink 80 newly remained during the recording operation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet printer comprising:

(i) at least one ink head which is opposed to a recording medium and jets ink to said recording medium, the ink head comprising (a) a nozzle-forming surface which has at least one nozzle for jetting ink, and (b) a curved surface which curves so as to separate from said recording medium as going downward in a vertical direction, the nozzle-forming surface and the curved surface being opposed to the recording medium; and (ii) at least one ink absorber which is detachable from the curved surface.

2. The ink jet printer according to claim 1, wherein a connected portion between said nozzle-forming surface and said curved surface is continuous.

3. The ink jet printer according to claim 1, further comprising a moving mechanism which moves said ink head relative to said recording medium.

4. The ink jet printer according to claim 1, wherein the curved surface has a portion that finally separates from the ink absorber moving away from the ink head.

5. An ink jet printer comprising:

(i) at least one ink head which is opposed to a recording medium and jets ink to said recording medium, the ink head comprising (a) a nozzle-forming surface which has at least one nozzle for jetting ink, and (b) a curved surface which curves so as to separate from said recording medium as going downward in a vertical direction, the nozzle-forming surface and the curved surface being opposed to the recording medium; and (ii) at least one slit extending along a longitudinal axis of the ink head on the curved surface, and reaching until a back surface of the ink head.

6. The ink jet printer according to claim 5, wherein said slit is formed in a center of the curved surface.

7. The ink jet printer according to claim 5, wherein said at least one slit comprises a plurality of slits.

8. The ink jet printer according to claim 5, wherein a connected portion between said nozzle-forming surface and said curved surface is continuous.

9. The ink jet printer according to claim 5, further comprising a moving mechanism which moves said ink head relative to said recording medium.

10. The ink jet printer according to claim 5, further comprising an ink absorber, the ink absorber being provided in a region where the at least one slit is formed in the back surface of said ink head.

11. An ink jet printer comprising:

(i) at least one ink head which is opposed to a recording medium and jets ink to said recording medium, the ink head comprising (a) a nozzle-forming surface which has a nozzle for jetting ink, and (b) a curved surface which curves so as to separate from said recording medium as going downward in a vertical direction, the nozzle-forming surface and the curved surface being opposed to the recording medium; and (ii) at least one ink absorber, the ink absorber being fixed to at least a part of said curved surface.

12. The ink jet printer according to claim 11, wherein a connected portion between said nozzle-forming surface and said curved surface is continuous.

13. The ink jet printer according to claim 11, further comprising a moving mechanism which moves said ink head relative to said recording medium.

14. An ink jet printer comprising:

(i) at least one ink head which is opposed to a recording medium and jets ink to said recording medium, the ink head comprising (a) a nozzle-forming surface which has a nozzle for jetting ink, and (b) an angular portion which is formed by said nozzle-forming surface and a surface intersecting the nozzle-forming surface, the nozzle-forming surface and the surface intersecting the nozzle-forming surface being opposed to the recording medium; and (ii) at least one ink absorber, the ink absorber being fixed to the ink head such that at least a part thereof contacts said angular portion.

15. The ink jet printer according to claim 14, wherein said angular portion is provided downward in a vertical direction rather than said nozzle-forming surface, and said ink absorber is provided downward in the vertical direction rather than said angular portion.

16. The ink jet printer according to claim 14, further comprising a moving mechanism which moves said ink head relative to said recording medium.

17. An ink jet printer comprising:

(i) at least one ink head which is opposed to a recording medium and jets ink to said recording medium; and (ii) at least one ink absorber which is detachable from a surface of the ink head opposing to the recording medium, wherein the ink absorber contacts the surface of said ink head opposing to the recording medium at an and of a purging operation of said ink head.

18. The ink jet printer according to claim 17, wherein said ink absorber contacts the surface of said ink head opposing to the recording medium at an end of a maintenance process of said ink head.

19. The ink jet printer according to claim 17, wherein said ink absorber contacts the surface of said ink head being opposed to the recording medium just before starting printing.

20. The ink jet printer according to claim 17, wherein said ink absorber contacts the surface of said ink head opposing to the recording medium during an image recording process to be performed after completion of a maintenance process of said ink head.

21. An ink jet printer comprising at least one ink head which jets ink to a recording medium surface of a recording medium, the ink head comprising:

(a) a nozzle plate which has at least one nozzle for jetting ink; and (b) at least one rib which projects toward a side of the recording medium rather than said nozzle;

wherein said rib has an end portion positioned on the side of the recording medium, and a groove opened toward the side of said recording medium surface is formed in said end portion.

22. The ink jet printer according to claim 21, wherein a side wall of said groove has an inclined plane which is oblique to said recording medium surface.

23. An ink jet printer comprising at least one ink head which jets ink to a recording medium surface of a recording medium, the ink head comprising:

(a) a nozzle plate which has at least one nozzle for jetting ink; and (b) at least one rib which projects toward a side of the recording medium rather than said nozzle, so as to prevent the recording medium surface from contacting the nozzle;

wherein the rib has an end portion positioned on the side of the recording medium, and a curved surface is formed on said end portion to prevent ink from staying on said end portion of the rib.

24. An ink jet printer comprising at least one ink head which jets ink to a recording medium surface of a recording medium, the ink head comprising:

(a) a nozzle plate which has at least one nozzle for jetting ink; and (b) at least one rib which projects toward a side of the recording medium rather than said nozzle;

wherein said rib is provided along a longitudinal axis of said ink head and has a proximal end portion on a side of the nozzle plate, and wherein a groove is formed in the proximal end portion of said rib along the longitudinal axis of said ink head.

25. The ink jet printer according to claim 24, wherein the rib and the groove have a side surface, and the side surface of the rib and the side surface of said groove are flush with each other.

26. The ink jet printer according to claim 24, wherein the groove has a longitudinal end portion, an ink absorber to absorb the ink is arranged on the longitudinal end portion.

* * * * *